United States Patent [19]

Ben-Nathan et al.

[11] 4,286,149

[45] Aug. 25, 1981

[54] APPARATUS AND METHOD FOR DETECTION OF OVERLAPPING OBJECTS

[75] Inventors: Samuel Ben-Nathan, Waterloo; Marwin G. Neumeister, Kitchener; Mikhail Shats, Waterloo; Robert S. McCallum, Erin, all of Canada

[73] Assignee: NCR Canada Ltd - NCR Canada Ltee, Mississauga, Canada

[21] Appl. No.: 65,383

[22] Filed: Aug. 9, 1979

[51] Int. Cl.[3] ..... G01V 9/04

[52] U.S. Cl. ..... 250/223 R; 250/222 PC

[58] Field of Search ..... 250/223 R, 221, 222 R, 250/222 PC; 235/92 V

[56] References Cited

U.S. PATENT DOCUMENTS

| | | | |
|---|---|---|---|
| 3,278,754 | 10/1966 | Wallace | 250/223 R |
| 3,283,163 | 11/1966 | Folmar | 250/223 R |
| 3,414,732 | 12/1968 | Stegenga | 250/223 R |
| 3,614,419 | 10/1971 | Daughton | 250/222 R |
| 3,737,666 | 6/1973 | Dutro | 250/223 R |
| 3,890,509 | 6/1975 | Maxey | 250/223 R |
| 3,892,492 | 7/1975 | Eichenberger | 250/571 |
| 3,932,755 | 1/1976 | Sagawa | 250/559 |
| 4,217,491 | 8/1980 | Dufford et al. | 235/92 V |

OTHER PUBLICATIONS

"Overlapped Document Detector", by J. K. Mullin, IBM Technical Disclosure Bulletin, vol. 6, No. 10, Mar. 1964, p. 52.

*Primary Examiner*—David C. Nelms

*Attorney, Agent, or Firm*—J. T. Cavender; Albert L. Sessler, Jr.

[57] ABSTRACT

Method and means are disclosed for detection of overlapped sheets transported along a path. A plurality of detection means are aligned substantially perpendicular to the direction of movement of said sheets, each detection means including one or more radiation sources and one or more radiation detectors. The overlapping of one sheet by another produces a shadow on the surface of the overlapped sheet along the edge of the overlapping sheet when radiation is directed obliquely on to the sheets from one of said radiation sources, the direction of such radiation necessary to produce a shadow being dependent on the direction of the overlap of one sheet by another. Reflected radiation from the sheets is received by one or more of the radiation detectors, and shadows or marks on the sheets are detected by reason of their lower reflectivity. Shadows indicating overlapped edges are distinguished from marks on the sheets by logic circuitry which signifies the presence of an overlap when one but not both of two samplings of the radiation detectors of all the radiation means shows a decrease in reflectivity.

25 Claims, 8 Drawing Figures

| FIRST DETECTOR & SOURCE 1 | SECOND DETECTOR & SOURCE 2 | FIRST DETECTOR SEES | SECOND DETECTOR SEES | DECISION |
|---|---|---|---|---|
|  |  RIGHT OVERLAP | SHADOW | NO SHADOW | OVERLAP |
|  |  LEFT OVERLAP | NO SHADOW | SHADOW | OVERLAP |
|  |  PLAIN OBJECT | NO SHADOW | NO SHADOW | NO OVERLAP |
|  |  PRINTED OBJECT | SHADOW | SHADOW | NO OVERLAP |

APPARATUS AND METHOD FOR DETECTION OF OVERLAPPING OBJECTS

BACKGROUND OF THE INVENTION

This invention relates to the detection of the overlapping of objects moving in a given path, and more particularly relates to method and apparatus for such detection employing one or more radiation sources for applying radiation to the surfaces of said objects and also employing detection means for receiving radiation reflected from the surfaces of said objects and detecting overlaps by shadows adjacent to an edge of one object which is overlapping another.

As the automatic transporting and processing of objects such as checks or currency in data processing systems and other types of systems has grown in recent years, the need has increased for a simple reliable means requiring minimal adjustment for detecting when one object, such as, for example, a check in a check sorting machine, or currency in an automatic money dispensing machine, has become overlapped with another, since such overlapping frequently produces undesirable results such as, for example, improper feeding of documents, or dispensing of an excessive amount of money from such devices as automated teller machines.

Examples of prior art double sheet detection systems are set forth in U.S. Pat. Nos. 3,278,754; 3,283,163 and 3,932,755.

SUMMARY OF THE INVENTION

The purpose of the present invention is to provide a method and means for detecting the overlapping of objects being serially fed along a predetermined path of movement.

According to one embodiment of the invention, an overlapped object detector for detecting overlaps in objects being transported along a defined path comprises detection means including radiation source means oriented to direct radiation against said objects as they pass said station and also including radiation sensing means, said sensing means associated with said radiation source means to receive radiation therefrom which has been reflected from an object passing said station, said sensing means providing two associated detection means output signals which are responsive to a decrease in reflectivity of an object caused by the edge of one object overlapping another object, or by a mark on an object; and logic means coupled to said detection means and capable of signifying when an overlap has taken place, said overlap being indicated by a change in one or the other, but not both, of the detection means output signals.

According to a second embodiment of the invention, a method for the detection of overlaps of objects which are being transported along a path of movement comprises the steps of directing radiation on to the surfaces of objects in said path to produce a shadow along the edge of any first object which overlaps a second object in a first direction; detecting any decrease in radiation reflected from said surfaces resulting from the shadow caused by said overlap in said first direction or from markings on one or more of said objects in a first sampling; directing radiation on to the surfaces of objects in said path to produce a shadow along the edge of any first object which overlaps a second object in a second direction opposite to said first direction; detecting any decrease in radiation reflected from said surfaces resulting from the shadow caused by said overlap in said second direction or from markings on one or more of said objects in a second sampling; and providing an overlap detection signal in response to the detection of a decrease in radiation in either of said first and second samplings, with no such signal being provided in response to the detection of a decrease in radiation by either both or neither of said two samplings.

It is accordingly an object of the present invention to provide an overlapped sheet detector.

Another object is to provide a method for the detection of overlaps of objects which are being transported along a path of movement.

A further object is to provide method and means for overlapped sheet detection which are unaffected by variations in sheet thickness and opacity.

An additional object is to provide an overlap sheet detector which is simple and efficient in design and does not require frequent adjustment.

With these and other objects, which will become apparent from the following description, in view, the invention includes certain novel features and combinations of parts, a plurality of forms or embodiments of which are hereinafter described with reference to the drawings which accompany and form a part of this specification.

DETAILED DESCRIPTION OF THE PREFERRED EMBODIMENTS

Figure 1:
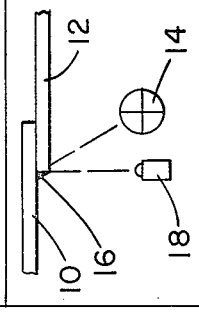
FIG. 1 is a decision chart, showing different combinations of sheet sensing situations and listing the decision made by the system of the present invention in each case.
Figure 1:
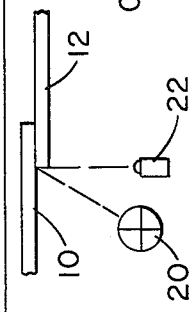
Figure 1:
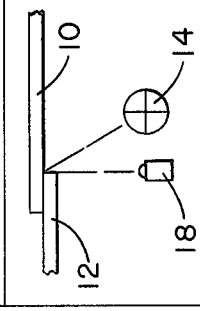
Figure 1:
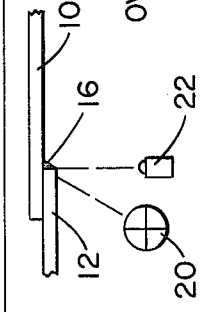
Figure 1:
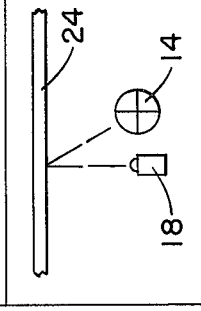
Figure 1:
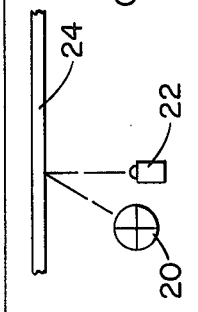
Figure 1:
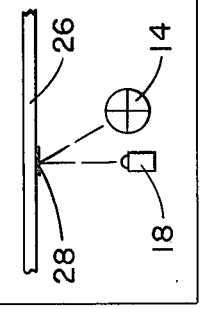
Figure 1:
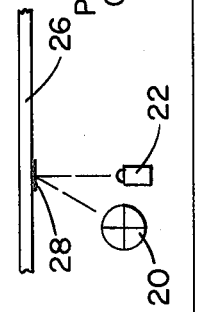

Referring now to the drawings, and particularly to FIG. 1, it will be understood that the present invention is suitable for use in a number of different types of systems in which objects such as checks or currency are serially fed, and in which the overlapping of such objects is to be avoided. Two examples of systems of this type are check sorters and currency dispensers.

As shown in the upper left view of FIG. 1, located in the "First Detector and Source 1" column and the "Right Overlap" row, if two overlapping objects such as sheets 10 and 12 are illuminated by a first radiation source 14 located obliquely in one direction from the line of overlap, an area of shadow 16 is produced. This shadow, with its contrast to the relatively highly reflective surfaces of the sheets 10 and 12, can be detected by a first radiation detector 18.

Conversely it may be seen by reference to the upper right view of FIG. 1, located in the "Second Detector and Source 2" column and the "Right Overlap" row, that when a second radiation source 20 is located obliquely from the point of sensing of a second radiation detector 22 in such a direction that radiation from the second source 20 does not produce a shadow at the overlap line between the sheets 10 and 12, but is reflected directly back to the second radiation detector 22, there is no overlap detection by said detector 22.

As will subsequently be described in greater detail, the first and second detector and source pairs are combined to provide a determination of whether or not an overlap of sheets exists. Reading to the right in the "Right Overlap" row of FIG. 1, it will be seen that the first detector 18 sees a shadow, the second detector 22 sees no shadow, and that this is interpreted by the system to constitute a detection of an overlap situation.

In the second row of FIG. 1, designated "Left Overlap", it will be noted that the second detector 22 sees a shadow 16 resulting from an overlap, while the first detector 18 sees no shadow. This also is interpreted by the system to constitute a detection of an overlap situation.

In the third row of FIG. 1, designated "Plain Object", only one sheet 24 is present and no overlap exists. Therefore neither the first detector 18 nor the second detector 22 sees a shadow, and this is interpreted by the system to constitute a situation in which no overlap is present.

Finally, in the fourth row of FIG. 1, designated "Printed Object" only one sheet is present, but sheet 26 bears a marking 28 which would be detected by the detectors 18 and 22 as the same reduction in radiation which would be produced by an overlap shadow. Consequently some means must be provided to distinguish one from the other and this is accomplished in the present invention by the use of two samplings of the reflectivity of a given area of the sheet 26. Two separate detectors 18 and 22 are used in the schematic diagrams of FIG. 1 to provide two separate samplings, but other means may also be employed, as will subsequently be described.

It will be seen that in the case of an overlap of sheets or objects, due to the oblique direction in which radiation is directed to the sheets, one or the other, but not both, of the detectors 18 and 22 will detect a shadow. On the other hand, in the case of a marking, such as the marking 28, on the surface of the object or sheet 26, this marking will be detected by both detectors 18 and 22. The system is therefore designed to distinguish between these conditions and to provide an overlap indication when at least one, but not both, of the detectors detects a shadow, or area of lower reflectivity.

It will be noted that in the embodiment of the invention shown in FIG. 1, the sheets are moving from left to right at a given rate, so the sampling of the same point on the sheet by the detector 22 takes place subsequently to the sampling of that point by the detector 18. Delay means are provided in the system, as will subsequently be explained, in order to enable the instantaneous comparison of signals from the two detectors.

Figure 2:
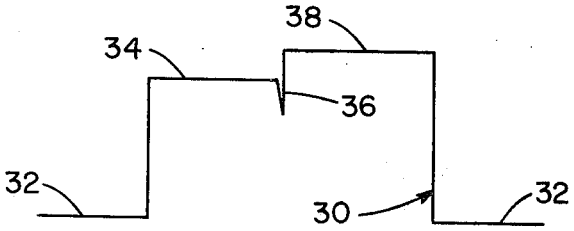
FIG. 2 shows a waveform representing a signal output from a radiation detector sensing a track which is initially vacant, and over which pass two overlapped sheets of varying reflectivity.

Shown in FIG. 2 is a typical waveform 30 of a signal taken from a radiation detector, such as detector 18 or 22. Proceeding from the left, the lowest level 32 represents the detector output when no sheet or object is positioned opposite the detector. Then as a sheet is fed past the detector, the output of the detector increases to a level 34. Passing of an overlap shadow past the detector results in a sharp negative spike 36, after which the signal returns to a different level 38, indicating the presence of another sheet of a possible different color. Passage of the sheet beyond the detector causes the signal to return to level 32. It will be noted that in this instance the levels 34 and 38 are not the same, indicating that the second sheet has an inherent higher reflectivity than the first sheet. However, this does not affect the ability of the system to detect the overlap, as evidenced by the spike 36.

Figure 3:
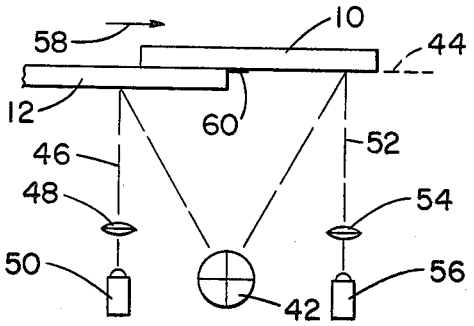
FIG. 3 is a schematic view of a sensing arrangement employing a single radiation source and two radiation sensors.
Figure 4:
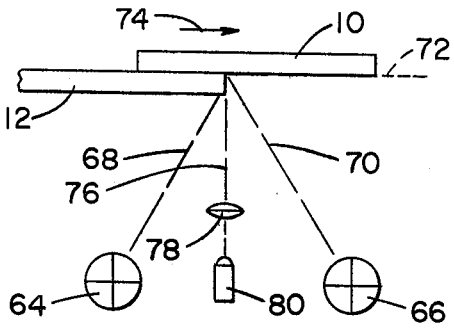
FIG. 4 is a schematic view of a sensing arrangement employing two alternately operable radiation sources and a single radiation sensor.
Figure 5:
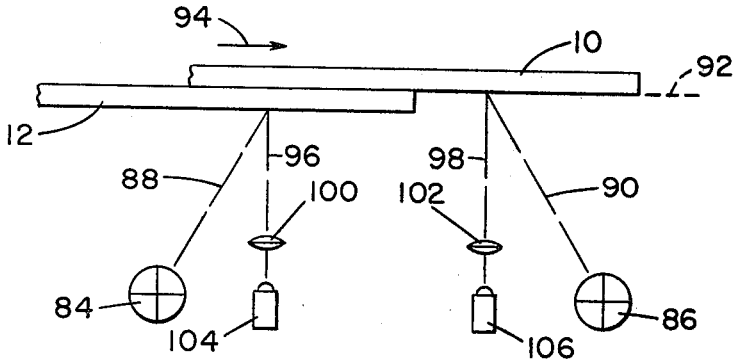
FIG. 5 is a schematic view of a sensing arrangement employing two radiation sources and two corresponding radiation sensors.

Schematically shown in FIGS. 3, 4 and 5 are three different embodiments of the invention. Different combinations of radiation sources and radiation detectors are employed to provide two samplings of radiation reflected from the sheet being scanned, from which the system of the present invention can make a decision as to whether or not an overlap is present.

In the embodiment of FIG. 3, a single radiation source 42 is positioned so that the radiation which it emits is reflected in a plurality of paths from sheets such as 10 or 12 moving along a line 44. Reflected radiation moving in a first path 46 passes through a lens 48 and impinges on a first radiation detector 50. Radiation moving in a second path 52 passes through a lens 54 and impinges on a second radiation detector 56. It will be seen that as the overlapped sheets move from left to right, as indicated in FIG. 3 by the arrow 58, the radiation from the source 42 is reflected from the sheets 10 and 12 through the lens 48 to the detector 50. This radiation will continuously be at a relatively high level, assuming the absence of any marks on the sheets 10 and 12, since no shadow will be seen by the detector 50. Consequently, the signal output level from said detector 50 will remain at a high level, though the level may change somewhat as the surface of the sheet 12, rather than the surface of the sheet 10, becomes the reflecting medium, if the reflecting characteristics of the two sheets are different, by virtue of differences in such qualities as color or texture.

On the other hand, the radiation from the source 42 which is reflected over the path 46 from the sheets 10 and 12 as they move from left to right, through the lens 54 to the radiation detector 56 will, at one point during the travel of the overlapped sheets, be at least partially blocked from reflection by the overlapped edge of the sheet 12 to produce a shadow 60. This will produce a sharp transient decrease in the signal output from the detector 56, corresponding to the negative spike 36 shown in FIG. 2. This change in signal level output from the detector 56 is used in determination by the system of an overlap condition, as will subsequently be described in greater detail. It may be seen that if the sheet overlap were in the other direction, that is, with sheet 12 positioned beneath and to the right of sheet 10 as viewed in FIG. 3, the blocking of radiation would be detected by the detector 50, rather than the detector 56, producing a low-level signal on the output of said detector 50.

In the embodiment of FIG. 4, two highly directional radiation sources 64 and 66 are positioned so that they emit radiation along paths 68, 70 respectively at opposite oblique angles with respect to the surfaces of sheets 10 and 12 which are moving past said sources along a line 72 in a direction from left to right as seen in FIG. 4, as indicated by the arrow 74. The radiation emitted by the sources 64 and 66 is reflected from the surfaces of the sheets 10 and 12 in a path 76 through a lens 78 to a radiation detector 80. The radiation sources 64 and 66 are energized at alternate times, so that samplings from the detector 80 can be taken at corresponding times and be identified as being associated with one or the other of the sources 64 and 66.

It will be seen that as the overlapped sheets move from left to right, as indicated in FIG. 4 by the arrow 74, the radiation from the source 66 is reflected from the sheets 10 and 12 over the path 76 through the lens 78 to the detector 80. This radiation will, whenever a sample is taken of the output from the detector 80, be at a high level, assuming the absence of any marks on the surfaces of sheets 10 and 12, since no overlap shadow will be seen by the detector 80. Consequently, all samplings of the signal output of the detector 80 which are taken coincidentally with the periodic energizing of the radiation source 66 will be at a high level, though the level may change somewhat as the surface of the sheet 12, rather than the surface of the sheet 10, becomes the reflecting medium, if the reflecting characteristics of the two sheets are different.

On the other hand, the radiation from the source 64 which is transmitted over the path 68 to the sheets 10 and 12, and reflected therefrom over the path 76 through the lens 78, impinging upon the detector 80, will, at one point during the travel of the overlapped sheets, be at least partially blocked from reflection by the overlapped edge of the sheet 12. Consequently, all samplings of the detector 80 which are taken coincidentally with the periodic energizing of the radiation source 64, during the time that the overlapped edge of the sheet 12 blocks radiation from a portion of the sheet 10 and produces a shadow thereon, will be at a relatively low level, indicating the presence of a shadow or a marking. This change in signal level output from the detector 80 is used in determination by the system of an overlap condition, as will subsequently be described in greater detail.

It may readily be seen that if the sheet overlap were in the other direction, that is with sheet 12 positioned beneath and to the right of sheet 10 as viewed in FIG. 4, the blocking of radiation from the source 66, rather than from the source 64, would produce a shadow which would result in a low-level signal on the output of detector 80.

In the embodiment of FIG. 5, two highly directional radiation sources 84 and 86 are positioned so that they emit radiation along paths 88 and 90 at opposite oblique angles with respect to the surfaces of sheets 10 and 12 which are moving past said sources along a line 92 in a direction from left to right as seen in FIG. 5, as indicated by the arrow 94. The radiation emitted by the sources 84 and 86 is reflected from the surfaces of the sheets 10 and 12 in paths 96 and 98 through lenses 100 and 102 to impinge upon radiation detectors 104 and 106, respectively.

It will be seen that as the overlapped sheets 10 and 12 move from left to right, as indicated in FIG. 5 by the arrow 94, the radiation from the source 86 is reflected from the sheets 10 and 12 through the lens 102 to the detector 106. This radiation will continuously be at a relatively high level, assuming the absence of any marks on the sheets 10 and 12, since no shadow will be seen by the detector 106. Consequently the signal output level from said detector will remain at a high level.

On the other hand, the radiation from the source 84, which is reflected over the path 96 from the sheets 10 and 12 as they move from left to right, through the lens 100 to the radiation detector 104 will, at one point during the travel of the overlapped sheets, be at least partially blocked from reflection by the overlapped edge of the sheet 12. This will produce a sharp transient decrease in the signal output from the detector 104, corresponding to the negative spike 36 shown in FIG. 2. This change in signal level output from the detector 104 is used in determination by the system of an overlap condition, as will subsequently be described in greater detail.

It may be seen that if the overlap is in the other direction, that is, with sheet 12 positioned beneath and to the right of sheet 10 as viewed in FIG. 5, the blocking of radiation would be detected by the detector 106, rather than the detector 104, producing a low-level signal on the output of detector 106.

Figure 6:
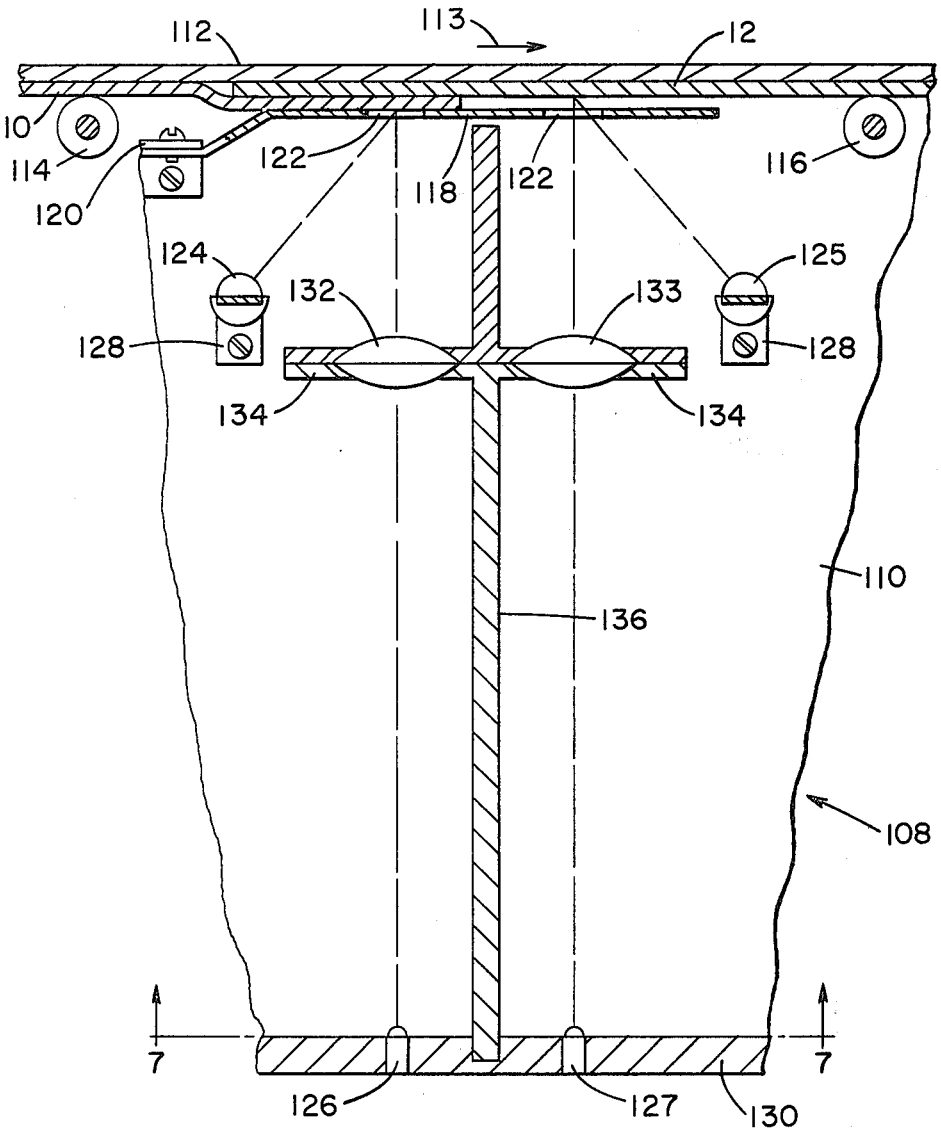
FIG. 6 is a sectional view, taken along line 6—6 of FIG. 7, of an apparatus embodying the arrangement of FIG. 5, utilizing a plurality of "stacked" combinations of radiation sources and radiation sensors.
Figure 7:
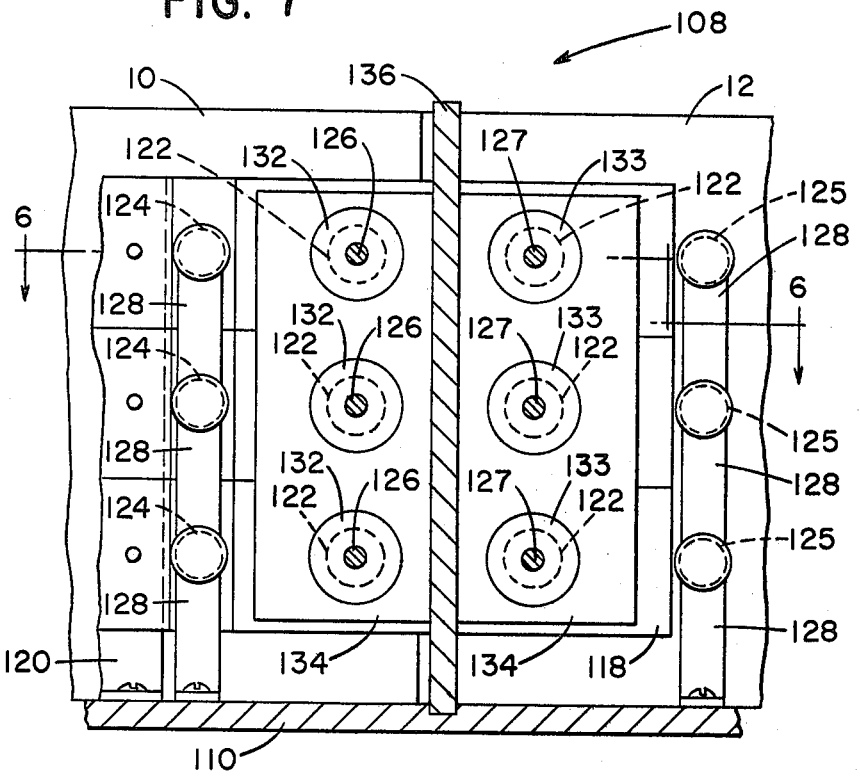
FIG. 7 is a sectional view, taken along line 7—7 of FIG. 6.

A more detailed showing of a suitable construction for the embodiment of FIG. 5 appears in FIGS. 6 and 7. A base member 110 supports the various mechanical elements of the system which comprise a sensing station 108 in operative relation.

Any suitable feeding means may be used to move the sheets 10, 12 along a desired path, past the sensing station 108. Sheet feeding means for various types of business machines are shown, for example, in U.S. Pat. No. 3,145,924, issued Aug. 25, 1964, inventors W. C. Rosener et al., and U.S. Pat. No. 3,363,756, issued Jan. 16, 1968, inventors D. E. Dykaar et al.

In the illustrated embodiment of FIGS. 6 and 7, the feeding means comprises a driving belt 112 and cooperating rollers 114 and 116, appropriately mounted on the base member 110, which cooperate to maintain sheets or documents 10, 12 in the desired orientation as they are fed. Said sheets are fed in the direction of the arrow 113, as viewed in FIG. 6.

A retaining plate 118 mounted on a support 120 secured to the base member 110 holds the sheet or sheets 10, 12 in a desired plane, against the belt 112, as they are advanced. As may be seen in FIG. 7, the plate is provided with a plurality of apertures 122 through which sensing of the surface of the sheet or sheets 10, 12 can take place. A total of six apertures 122 are provided in the illustrated embodiment, forming three vertically aligned pairs of apertures, each pair being associated with a corresponding pair of radiation sources and a pair of radiation detectors. If desired, the plate 118 could, of course, be made in three separate sections, each including a pair of apertures 122, as shown in FIG. 7.

In the plan view of FIG. 6, the uppermost pair of radiation sources 124, 125 and radiation detectos 126, 127 are shown in operative relation. The radiation sources may, for example, be infra-red light emitting diodes of type SPX-1762 manufactured by Spectronics, Inc. and the radiation detectors may, for example, be infrared phototransistors of type SPX-1762 manufactured by Spectronics, Inc. Of course, other suitably matches sources and detectors may be employed, if desired. Two other corresponding pairs of radiation sources 124, 125 and detectors 126, 127 are included in the system, as shown in the sectional view of FIG. 7.

The radiation sources 124, 125 are mounted in supports 128, and the radiation detectors 126, 127 are mounted in a support 130. Between the sources 124, 125 and the detectors 126, 127 a plurality of lenses 132, 133 corresponding to the detectors 126, 127 are mounted in a support 134. All of the supports 128, 130 and 134 may be secured to the base member 110.

The radiation sources 124, 125 each provide a narrow band of radiation which is directed at a predetermined angle to the sheets 10, 12. Since these sheets are comprised of a multitude of pressed fibers, the surfaces of said sheets are slightly irregular, and are at varying angles of inclination, rather than being absolutely planar and parallel to the direction of sheet movement indicated by the arrow 113, causing radiation reflected therefrom to be diffused. Accordingly, the paths of radiation from the sources 124, 125 to the sheets 10, 12, and thereafter by reflection to the lenses 132, 133, as shown in FIG. 6, are consistent with an arrangement of optical elements which assumes the existence of varying irregularities in the surface configurations of the sheets 10, 12, with certain of said surface irregularities being of the proper inclination to reflect portions of the beam from the sources 124, 125 to the lenses 132, 133.

A partition or divider 136 supported on base member 110 is located between the corresponding elements of the various pairs of radiation sources 124, 125 and detectors 126, 127, and serves to block radiation from one source 124 or 125 from impinging on the opposite detector 127 or 126, which could otherwise result in spurious sensings. Its surfaces are matte black, in the illustrated embodiment, in order to minimize undesired reflectivity.

Figure 8:
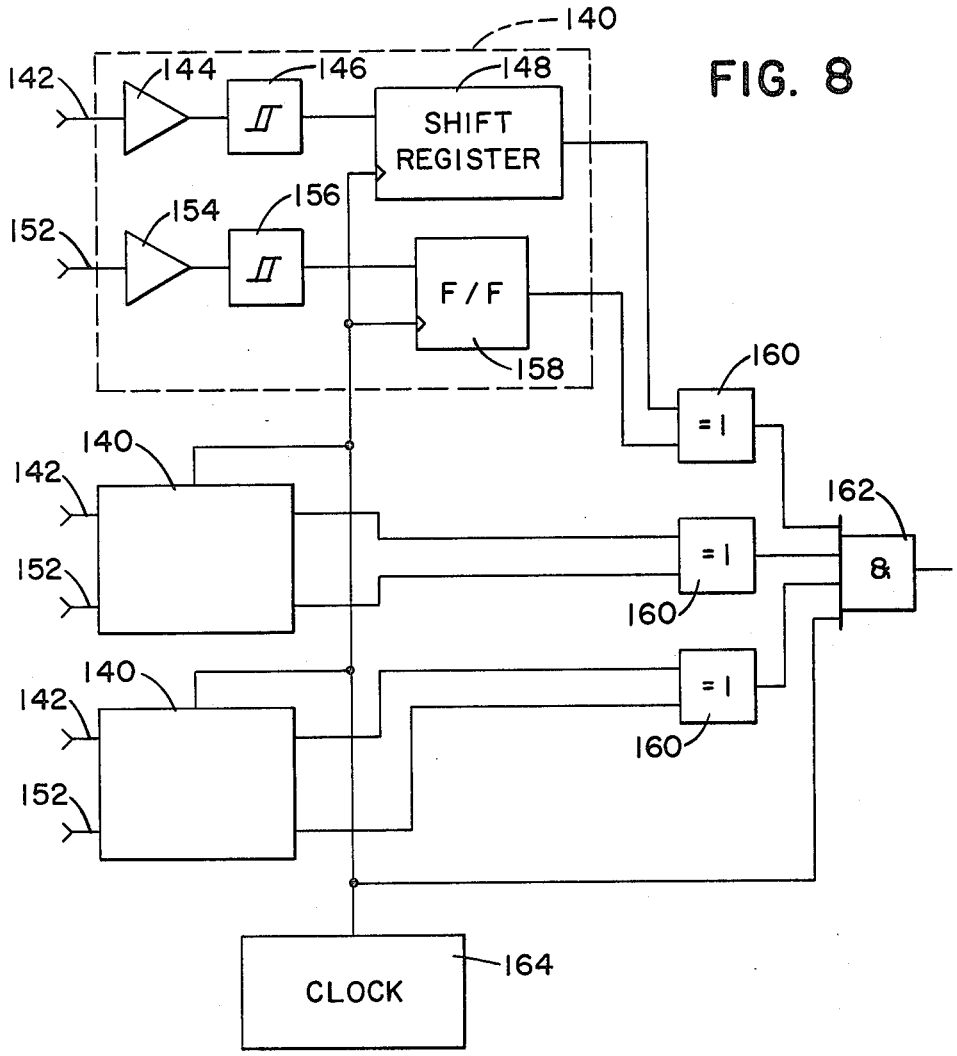
FIG. 8 is a diagram showing system circuitry which may be utilized in detection of an overlap in objects being fed.

Operation of the sensing station 108 will now be described in connection with the operation of the system circuitry, shown in FIG. 8. In that circuit, one sub-circuit, represented by block 140, is provided for each pair of detectors 126, 127. In FIG. 8, one of said blocks is shown in detail, and the other two are identical thereto.

It should be realized that while three pairs of detectors 126, 127 are employed in the illustrated embodiment of the invention, overlap detection could be accomplished with relatively small error using only one pair of detectors, while some other larger number of pairs of detectors could be employed if desired. The use of a number of pairs of detectors aids substantially in minimizing the likelihood of errors which might otherwise result from mistaking a condition such as a fold, which could conceivably produce a shadow on one side, but not the other, of the fold, and which extends partially across a sheet being fed, for an actual overlap condition. Of course it is still possible to have an erroneous overlap detection signal generated by the system in resonse to a condition such as a fold which could extend substantially completely across the sheet at right angles to the direction of feeding, such condition thus resembling an overlap shadow.

In each sub-circuit block 140, a first input 142, which is coupled to an output from a radiation detector 126, is coupled through an amplifier 144 and a Schmitt trigger 146 to an input of a 64-bit shift register 148, which provides a delay function, as will subsequently be described. A second input 152, which is coupled to an output from a radiation detector 127, is coupled through an amplifier 154 and a Schmitt trigger 156 to an input of a D-type flip-flop 158, in which the output is the same as the input one clock time later. The amplifiers 144 and 154 may be of type LM324, manufactured by Motorola, Inc. The Schmitt triggers 146 and 156 may be of type LM311, manufactured by Motorola, Inc. The shift register 148 may be of type CD4031, manufactured by RCA Corporation. The flip-flop 158 may be of type SN7474, manufactured by Texas Instruments, Inc. Obviously, other similar devices manufacturered by other manufacturers may be used, if desired, for the circuit elements mentioned above, and other circuit elements referred to subsequently.

The outputs from shift register 148 and flip-flop 158 of each sub-circuit block 140 are applied as inputs to an EXCLUSIVE OR gate 160, which may by of type CD4030, manufactured by RCA Corporation. Outputs of the three EXCLUSIVE OR gates 160 are applied as inputs to an AND gate 162, which may be of type CD4023, manufactured by RCA Corporation. The output of the AND gate 162 constitutes the output from the system, which provides information as to whether or not an overlap condition exists, in accordance with the signal level on said output.

Timing of the circuit of FIG. 8 is controlled by a 488 KHz. clock 164, which may be of type CD4069, manufactured by RCA Corporation. As may be seen in FIG. 8, clock pulses from the clock 164 are applied to the shift register 148 and the clock 158 of each sub-circuit 140, as well as to the AND gate 162.

The operation of the system of the present invention will now be described, with particular reference to FIGS. 6, 7 and 8. In the normal course of operation of the system, sheets such as 10 are fed from left to right as viewed in FIG. 6 by the feeding mechanism 112, 114, 116, at a predetermined speed. The retaining plate 118 maintains the sheet 10 in proper position as it moves past the sensing station 108.

As the sheets move past the sensing station 108, radiation from the sources 124 and 125 is continuously directed through the apertures 122 in the plate 118, and is reflected from the sheets 10 back through the lenses 132 and 133 to impinge upon the radiation detectors 126 and 127. It will be noted that a given point on a sheet passes under the radiation from the source 124 at a time prior to the time at which it passes under the radiation from the source 125, the time interval being dependent upon the speed at which the sheet 10 is being moved past the sensing station 108. Since it is desirable from proper system operation that a simultaneous comparison of the output signals from all of the detectors 126 and 127 be made, a delay is provided for the signals derived from the detectors 126, as will subsequently be described in greater detail.

The output from each detector 127, coupled to a terminal 152 (FIG. 8), is amplified by an amplifier 154, squared by a Schmitt trigger 156, and applied to an input of the "D" type flip-flop 158, which is also controlled by signals from the clock 164. The output of the flip-flop 158 will assume the same logic level as the pulse received at the input terminal 152, amplified and shaped by the elements 154 and 156, and applied to the input of the flip-flop 158, one clock pulse time later.

The output from each detector 126, coupled to a terminal 142 (FIG. 8), is amplified by an amplifier 144, squared by a Schmitt trigger 146, and applied to an input of the shift register 148, which is also controlled by signals from the clock 164. The shift register can be set in accordance with the speed of movement of the sheet 10 past the sensing station 108, by utilizing all or only a portion of the total number of stages (sixty-four, in the illustrated embodiment) of the shift register, so that the output of a given signal from the shift register 148, representing a output from the detector 126, coincides in time with the output of a given signal from the flip-flop 158, representing an output from the detector 127. These two outputs represents the sensings by the two detectors, separated in acutal time and space, of the same point on a given sheet 10 passing the sensing station 108.

As previously described, these two signals are applied in each case to the two inputs of an EXCLUSIVE OR gate 160. If the two signals are both at the same level, either high or low, a first signal level will be found at the output of the EXCLUSIVE OR gate 160, while if the two signals are at different levels, a second signal level will be found at the output of the EXCLUSIVE OR gate 160. The outputs of all three of the gates 160 are in turn applied to the AND gate 162 where, if all of the inputs thereto are at a given logic level, the output thereof will be at the same level. Thus, for example, if the paired inputs to the gates 160 each include one low and one high level signal, the outputs of all three gates 160 will be high, and the output of the AND gate 162 will be high, indicating that an overlap condition has been detected by the sensing station 108. On the other hand, if any one or more of the three pairs of detectors are either both high or both low, the output of the AND gate 162 will indicate that an overlap condition is not present.

While the forms of the invention shown and described herein are admirably adapted to fulfill the objects primarily stated, it is to be understood that it is not intended to confine the invention to the forms or embodiments disclosed herein, for it is susceptible of embodiment in various other forms within the scope of the appended claims.

What is claimed is:

1. An overlapped object detector comprising:

means for transporting objects along a defined path;

a station including a plurality of detection means aligned substantially perpendicular to the direction of movement of said objects, each detection means including first and second radiation sources oriented to direct radiation obliquely against said objects as they pass said station, also including first and second radiation sensing means, and first and second lens means associated respectively with said first and second sensing means, each sensing means paired respectively with its corresponding radiation source to receive radiation therefrom which has been reflected from an object passing said station and directed to said sensing means by its associated lens means, said sensing means being able to detect a decrease in reflectivity of an object caused by the edge of one object overlapping another object, or by a mark on an object; and logic means coupled to said detection means for signifying when an overlap has taken place, said overlap being indicated by a detection by one or the other, but not both, of the radiation sensing means of all of said detection means of a decrease in reflectivity.

2. The overlapped object detector of claim 1, also including radiation-opaque means disposed between the first and second pair of sensing means and radiation source in each detection means.

3. The overlapped object detector of claim 1, also including apertured resilient means for maintaining said objects in proper position as they are transported along said path, said apertures permitting impingement on and reflection from said objects of said radiation.

4. An overlapped object detector comprising:

means for transporting objects along a defined path;

a station including a plurality of detection means aligned substantially perpendicular to the direction of movement of said objects, each detection means including first and second radiation sources oriented to direct radiation against said objects as they pass said station and also including first and second radiation sensing means, each sensing means paired respectively with its corresponding radiation source to receive radiation therefrom which has been reflected from an object passing said station, said sensing means being able to detect a decrease in reflectivity of an object caused by the edge of one object overlapping another object, or by a mark on an object; and logic means coupled to said detection means for signifying when an overlap has taken place, said overlap being indicated by a detection of a decrease in reflectivity by one or the other, but not both, of the radiation sensing means of all of said detection means.

5. An overlapped object detector comprising:

means for transporting objects along a defined path;

detection means including first and second radiation sources oriented to direct radiation against said objects as they pass said station and also including first and second radiation sensing means, each sensing means paired respectively with its corresponding radiation source to receive radiation therefrom which has been reflected from an object passing said station, said sensing means being able to detect a decrease in reflectivity of an object caused by the edge of one object overlapping another object, or by a mark on an object; and logic means coupled to said detection means for signifying when an overlap has taken place, said overlap being indicated by a detection of a decrease in reflectivity by one or the other, but not both, of the radiation sensing means of said detection means.

6. An overlapped object detector comprising:

means for transporting objects along a defined path;

a station including a plurality of detection means aligned substantially perpendicular to the direction of movement of said objects, each detection means including a radiation source oriented to direct radiation against said objects as they pass said station and also including first and second spaced apart radiation sensing means, each sensing means directed to a different point on said defined path and positioned to receive radiation from said radiation source which has been reflected from an object passing said station, said sensing means being able to detect a decrease in reflectivity of an object caused by the edge of one object overlapping another object, or by a mark on an object; and logic means coupled to said detection means for signifying when an overlap has taken place, said overlap being indicated by a detection of a decrease in reflectivity by one or the other, but not both, of the radiation sensing means of all of said detection means.

7. An overlapped object detector comprising:

means for transporting objects along a defined path;

detection means including a radiation source oriented to direct radiation against said objects as they pass said station and also including first and second spaced apart radiation sensing means, each sensing means directed to a different point on said defined path and positioned to receive radiation from said radiation source which has been reflected from an object passing said station, said sensing means being able to detect a decrease in reflectivity of an object caused by an edge of one object overlapping another object, or by a mark on an object; and logic means coupled to said detection means for signifying when an overlap has taken place, said overlap being indicated by a detection of a decrease in reflectivity by one or the other, but not both, of the radiation sensing means of said radiation means.

8. An overlapped object detector comprising:

means for transporting objects along a defined path;

a station including a plurality of detection means aligned substantially perpendicular to the direction of movement of said objects, each detection means including first and second alternately operable radiation sources oriented to direct radiation obliquely against said objects as they pass said station and also including radiation sensing means positioned to receive radiation alternately from said first and second radiation sources, said radiation being reflected from an object passing said station, said sensing means being able to detect a decrease in reflectivity of an object caused by the edge of one object overlapping another object, or by a mark on an object; and logic means coupled to said detection means for signifying when an overlap has taken place, said overlap being indicated by a detection of a decrease in reflectivity by the sensing means of all of said detection means during one or the other, but not both, of two consecutive times of operation of said first and second radiation means.

9. An overlapped object detector comprising:

means for transporting objects along a defined path;

detection means including first and second alternately operable radiation sources oriented to direct radiation obliquely against said objects as they pass said station and also including radiation sensing means positioned to receive radiation alternately from said first and second radiation sources, said radiation being reflected from an object passing said station, said sensing means being able to detect a decrease in reflectivity of an object caused by the edge of one object overlapping another object, or by a mark on an object; and logic means coupled to said detection means for signifying when an overlap has taken place, said overlap being indicated by a detection of a decrease in reflectivity by said sensing means during one or the other, but not both, of two consecutive times of operation of said first and second radiation sources.

10. An overlapped object detector for detecting overlaps in objects being transported along a defined path comprising:

detection means including radiation source means oriented to direct radiation against said objects as they pass said station and also including radiation sensing means, said sensing means associated with said radiation source means to receive radiation therefrom which has been reflected from an object passing said station, said sensing means providing two associated detection means output signals which are responsive to a decrease in reflectivity of an object caused by the edge of one object overlapping another object, or by a mark on an object; and logic means including delay means for delaying one of the detection means output signals, coupled to said detection means and capable of signifying when an overlap has taken place, said overlap being indicated by a change in one or the other, but not both, of the detection means output signals.

11. The overlapped object detector of claim 10 in which said logic means includes exclusive-or gating means for providing an overlap signal when one or the other, but not both, of the detection means output signals indicates a decrease in reflectivity.

12. An overlapped object detector for detecting overlaps in objects being transported along a defined path comprising:

a station including a plurality of detection means aligned substantially perpendicular to the direction of movement of said objects, each detection means including radiation source means oriented to direct radiation against said objects as they pass said station and also including radiation sensing means, said sensing means associated with its corresponding radiation source means to receive radiation therefrom which has been reflected from an object passing said station, said sensing means providing two associated detection means output signals which are responsive to a decrease in reflectivity of an object caused by the edge of one object overlapping another object, or by a mark on an object; and logic means including a plurality of delay means for delaying one of the detection means output signals of each detection means, coupled to said detection means and capable of signifying when an overlap has taken place, said overlap being indicated by a change in one or the other, but not both, of the detection means output signals of each of said detection means.

13. The overlapped object detector of claim 12 in which said logic means includes a number of exclusive-or gates equal to the plurality of detection means for providing a signal when one or the other, but not both, of the detection means output signals applied thereto indicates a decrease in reflectivity.

14. The overlapped object detector of claim 12 in which said logic means also includes an AND gate to which the output of all of said exclusive-or gates are applied, the output of said AND gate providing signification of when an overlap has taken place.

15. A method for the detection of overlaps of objects which are being transported along a path of movement comprising the steps of:

A. directing radiation on to the surfaces of objects in said path to produce a shadow along the edge of any first object which overlaps a second object in a first direction;

B. detecting any decrease in radiation reflected from said surfaces resulting from the shadow caused by said overlap in said first direction or from markings on one or more of said objects in a first sampling;

C. directing radiation on to the surfaces of objects in said path to produce a shadow along the edge of any first object which overlaps a second object in a second direction opposite to said first direction;

D. detecting any decrease in radiation reflected from said surfaces resulting from the shadow caused by said overlap in said second direction or from markings on one or more of said objects in a second sampling; and E. providing an overlap detection signal in response to the detection of a decrease in radiation in either of said first and second samplings, with no such signal being provided in response to the detection of a decrease in radiation by either both or neither of said two samplings.

16. The method of claim 15 in which the radiation is directed in a first direction from a first radiation source in step A, and in a second direction from a second radiation source in step C.

17. The method of claim 16 in which the detection of any decrease in radiation in steps B and D is accomplished at different times by one radiation detector.

18. The method of claim 15 in which the detection of any decrease in radiation in steps B and D is accomplished at two separate spaced-apart locations.

19. The method of claim 16 in which the detection of any decrease in radiation in steps B and D is accomplished at two separate spaced-apart locations.

20. A method for the detection of overlaps of objects which are being transported along a path of movement comprising the steps of:

A. directing radiation on to he surfaces of objects in said path to produce shadows along the edge of any first object which overlaps a second object in a first direction;

B. detecting any decrease in radiation reflected from said surfaces resulting from the shadow caused by said overlap in said first direction or from markings on one or more of said objects in a first plurality of samplings;

C. directing radiation on to the surfaces of objects in said path to produce shadows along the edge of any first object which overlaps a second object in a second direction opposite to said first direction;

D. detecting any decrease in radiation reflected from said surfaces resulting from the shadows caused by said overlap in said second direction or from markings on one or more of said objects in a second plurality of samplings; and E. providing an overlap detection signal in response to the detection of a decrease in radiation in either all of said first plurality of samplings or all of said second plurality of samplings, with no such signal being provided in response to any other combination of radiation decrease detections.

21. The method of claim 20 in which the radiation is directed in a first direction from a first plurality of radiation sources in step A, and in a second direction from a second plurality of radiation sources in step C.

22. The method of claim 20 in which the detection of any decrease in radiation in steps B and D is accomplished at different times in different samplings at the same plurality of locations.

23. The method of claim 21 in which the detection of any decrease in radiation in steps B and D is accomplished in different samplings at a first and second plurality of locations, respectively.

24. The method of claim 20 in which the detection of any decrease in radiation in steps B and D is accomplished in different samplings at a first and a second plurality of locations, respectively.

25. The method of claim 24 in which the radiation is directed from the same plurality of radiation sources in steps A and C.

* * * * *